US005526826A

United States Patent [19]

Heitmann

[11] Patent Number: 5,526,826

[45] Date of Patent: Jun. 18, 1996

[54] APPARATUS FOR REMOVING SURPLUS FROM A TOBACCO STREAM

[75] Inventor: Uwe Heitmann, Hamburg, Germany

[73] Assignee: Hauni Maschinenbau AG, Hamburg, Germany

[21] Appl. No.: 281,781

[22] Filed: Jul. 28, 1994

[30] Foreign Application Priority Data

Sep. 29, 1993 [DE] Germany ..... 43 33 046.0

[51] Int. Cl.[6] ..... A24C 5/39

[52] U.S. Cl. ..... 131/84.4

[58] Field of Search ..... 131/84.4, 83.1

[56] References Cited

U.S. PATENT DOCUMENTS

| | | | |
|---|---|---|---|
| 3,261,366 | 7/1966 | Richter et al. | 131/84.4 |
| 3,413,979 | 12/1968 | Korber | 131/84.4 X |
| 4,210,159 | 7/1980 | Quarenghi . | |
| 4,485,826 | 12/1984 | Holzangel | 131/84.4 |
| 4,693,262 | 9/1987 | Goldbach et al. | 131/84.4 X |
| 4,703,764 | 11/1987 | Marguardt et al. | 131/84.4 |
| 5,003,996 | 4/1991 | Tallier et al. | 131/84.4 X |

FOREIGN PATENT DOCUMENTS

| | | |
|---|---|---|
| 0137604 | 4/1985 | European Pat. Off. . |
| 2949494 | 6/1981 | Germany . |
| 919150 | 2/1963 | United Kingdom . |
| 1024941 | 4/1966 | United Kingdom . |
| 2072483 | 10/1981 | United Kingdom . |

*Primary Examiner*—Jennifer Bahr
*Attorney, Agent, or Firm*—Darby & Darby

[57] ABSTRACT

Apparatus for removing surplus at one side of an unequalized tobacco stream includes a transporting unit with a pneumatic conveyor having an endless foraminous belt which overlies the stream and defines with two sidewalls a channel for advancement of the stream along an elongated path so that the surplus extends downwardly beyond a preselected distance from the underside of the belt. The mechanism for trimming the surplus off the moving stream comprises two disc-shaped gripping members which define a nip for the entry of successive increments of the stream directly above the surplus, and a rotary knife having a circular cutting edge which separates the surplus from the major portion of the stream immediately below the nip. The knife can form part of or can be disposed immediately above a coaxial rotary deflector which directs the severed suplus in a desired direction. A driven rotary paddle wheel can be installed upstream of the nip to remove some of the surplus, and a rotary device which compacts longitudinally spaced apart portions of the stream can be installed between the paddle wheel and the nip.

16 Claims, 2 Drawing Sheets

APPARATUS FOR REMOVING SURPLUS FROM A TOBACCO STREAM

BACKGROUND OF THE INVENTION

The invention relates to improvements in apparatus for removing surplus from a stream of particles of natural, reconstituted and/or substitute tobacco, hereinafter referred to as tobacco. More particularly, the invention relates to apparatus for removing surplus from a stream which is being transported by a pneumatic conveyor, for example, from the distributor (also called hopper) to the wrapping mechanism of a tobacco rod making machine.

The distributor of a rod making machine (such as a cigarette rod maker) is constructed and assembled to deliver at least one continuous stream of tobacco particles to a pneumatic conveyor, such as a conveyor which includes an endless foraminous belt, means for driving the belt, and a suction chamber adjacent one side of an elongated reach or stretch of the belt so that the particles of tobacco forming a stream are attracted to the other side of the reach or stretch and are advanced to a mechanism wherein successive increments of the stream are confined in a continuous web of suitable wrapping material, such as cigarette paper. The stream which issues from the distributor contains a surplus of tobacco particles, and such surplus is removed by a trimming mechanism so that the remainder of the stream (called filler) constitutes a continuous rod which advances through the wrapping mechanism to emerge in the form of a cigarette rod ready to be subdivided into rod-shaped articles of unit length or multiple unit length. The stream is normally obtained by showering tobacco particles onto or against the other side of the aforementioned stretch or reach of the foraminous belt. Such stream contains a surplus of particles because this ensures that, after trimming, each unit length of the filler contains the same quantity or a desired quantity of tobacco particles. It is also known to densify longitudinally spaced apart portions of the stream so that the corresponding portions of the filler contain more tobacco than the portions between successive densified portions. Such procedure is adhered to if the maker is to turn out plain cigarettes, cigars or cigarillos with dense ends. If a rod-shaped article of the tobacco processing industry is provided with one or two dense ends, it is less likely to lose particles at the dense end or ends, e.g., during storage, during transport to a packing machine, during transport to a filter tipping machine or subsequent to opening of a packet containing a number of parallel smokers' products.

Heretofore known trimming or equalizing mechanisms which are used to separate the surplus from the remainder of a tobacco stream upstream of the wrapping station normally comprise a pair of discs which clamp successive increments of the stream between the surplus and the major portion of the respective increment of the stream, and a surplus removing tool, such as a paddle wheel, which brushes or sweeps the surplus at those sides of the discs which face away from the major portion of the stream. Reference may be had, for example, to U.S. Pat. No. 4,210,159.

It is also known to remove the surplus by resorting to a milling tool which is oriented in such a way that it acts not unlike a paddle wheel, i.e., the tool sweeps the surplus away from the remainder of the stream. Such milling tool is disclosed in the published German patent application No. 29 49 494.

A drawback of the trimming mechanisms which employ a paddle wheel or a milling tool is that the rapidly orbiting paddles or cutting edges not only remove the surplus from the remaining (equalized) portion of the stream but also subject the removed surplus to an undesirable comminuting action. The orbiting paddles of a wheel or the orbiting cutting edges of a milling tool actually tear the surplus off the major portion of the moving stream and propel the thus separated and comminuted particles away from the clamping discs. This reduces the quality of the removed surplus as well as of the rod-shaped articles because the removed surplus is reintroduced into the distributor and is admixed to tobacco which is showered onto or against the aforementioned foraminous belt. Moreover, heretofore known trimming mechanisms cannot ensure that all or practically all particles of the removed surplus can be gathered for predictable reintroduction into the distributor of a tobacco rod making machine, such as a cigarette maker.

OBJECTS OF THE INVENTION

An object of the invention is to provide a novel and improved apparatus for removing surplus from a continuous stream of tobacco particles.

Another object of the invention is to provide the apparatus with novel and improved means for separating the surplus from the remainder of a moving stream of tobacco shreds or other types of particles.

A further object of the invention is to provide an apparatus which, save for a comminuting action necessary to separate the surplus from a moving stream of tobacco particles, does not or does not appreciably comminute the particles of the removed surplus.

An additional object of the invention is to provide the apparatus with novel and improved means for confining the removed surplus to movement in a desired direction or in a plurality of desired directions.

Still another object of the invention is to provide a compact and relatively simple apparatus which can be utilized as a superior substitute for heretofore known surplus removing apparatus.

A further object of the invention is to provide a novel and improved combination of surplus removing and surplus directing means for use in the above outlined apparatus.

Another object of the invention is to provide a novel and improved method of separating the surplus from a tobacco stream which is to be draped into a web of cigarette paper or other suitable wrapping material.

An additional object of the invention is to provide a maker of rod-shaped articles of the tobacco processing industry which employs one or more surplus removing apparatus of the above outlined character.

Still another object of the invention is to provide a novel and improved combination of plural trimming or equalizing units which can be utilized in the improved apparatus.

SUMMARY OF THE INVENTION

The invention is embodied in an apparatus for removing surplus from a stream of tobacco particles. The improved apparatus comprises means for transporting the stream in a predetermined direction along a predetermined path, and such transporting means includes a pneumatic conveyor having means for advancing the stream along the predetermined path and two sidewalls flanking the path so that the surplus extends beyond a predetermined distance and in a direction away from the advancing means. The apparatus further comprises means for trimming the surplus off the stream, and such trimming means includes two rotary gripping members which are spaced apart from the conveyor and define a nip which is disposed between the sidewalls at least substantially at the predetermined distance from the advancing means and receives successive increments of the stream between the surplus and the stream portion intermediate the nip and the advancing means. The trimming means further comprises means for rotating the gripping members in opposite directions and means for severing the surplus off the remainder of the stream at the nip. The severing means includes a rotary knife having a substantially circular cutting edge adjacent the gripping members so that the gripping members are disposed between the knife and the advancing means.

The arrangement is preferably such that the gripping members include or constitute discs which are disposed in a first plane and that the cutting edge of the rotary knife is disposed in a second plane which is adjacent and at least substantially parallel to the first plane.

The nip can be disposed at least substantially midway between the sidewalls of the transporting means and narrows in the direction of advancement of the stream along its path.

The advancing means preferably includes a substantially planar stream contacting portion between the two sidewalls, and the trimming means preferably further includes means for rotating the knife about an axis which is normal or substantially normal to the plane of the stream contacting portion.

The apparatus preferably further includes means for directing the severed surplus in at least one predetermined direction, and such directing means can comprise a rotary deflector which is coaxial with the rotary knife. The deflector has a side which confronts the gripping members, and the knife is or can be disposed at such side of the deflector. In accordance with two presently preferred embodiments, the deflector can be provided with a substantially frustoconical deflecting surface or with a concave deflecting surface for the severed surplus. The knife can constitute a portion of the directing means, and at least such portion is or can be hardened.

The apparatus can further comprise means for compacting longitudinally spaced-apart portions of the stream upstream of the nip which is defined by the gripping members. The compacting means can comprise a driven rotary holder and one or more projections which are provided on the holder in such positions that each projection compacts an adjacent portion of the advancing stream once during each revolution of the holder.

Still further, the apparatus can comprise means for removing some of the surplus from the stream ahead or upstream of the nip (as seen in the predetermined direction) to thus at least partially equalize the stream prior to removal of the remaining surplus by the trimming means. Such surplus removing means is located upstream of the compacting means if the apparatus is provided with compacting means. In accordance with a presently preferred embodiment of the invention, the means for removing some of the surplus can comprise a driven paddle wheel rotatable about an axis which is inclined relative to the predetermined direction.

The sidewalls and the advancing means of the transporting means preferably define an elongated channel having an open side, and the trimming means is then adjacent the open side of the channel. The open side of the channel can be disposed at a level beneath the advancing means.

The conveyor of the transporting means can include an endless foraminous belt, and the advancing means can constitute or form part of an elongated stretch or reach of the foraminous belt. The stretch or reach extends in the predetermined direction and is disposed at a level other than the level of the trimming means.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawings.

DESCRIPTION OF PREFERRED EMBODIMENTS

Figure 1:
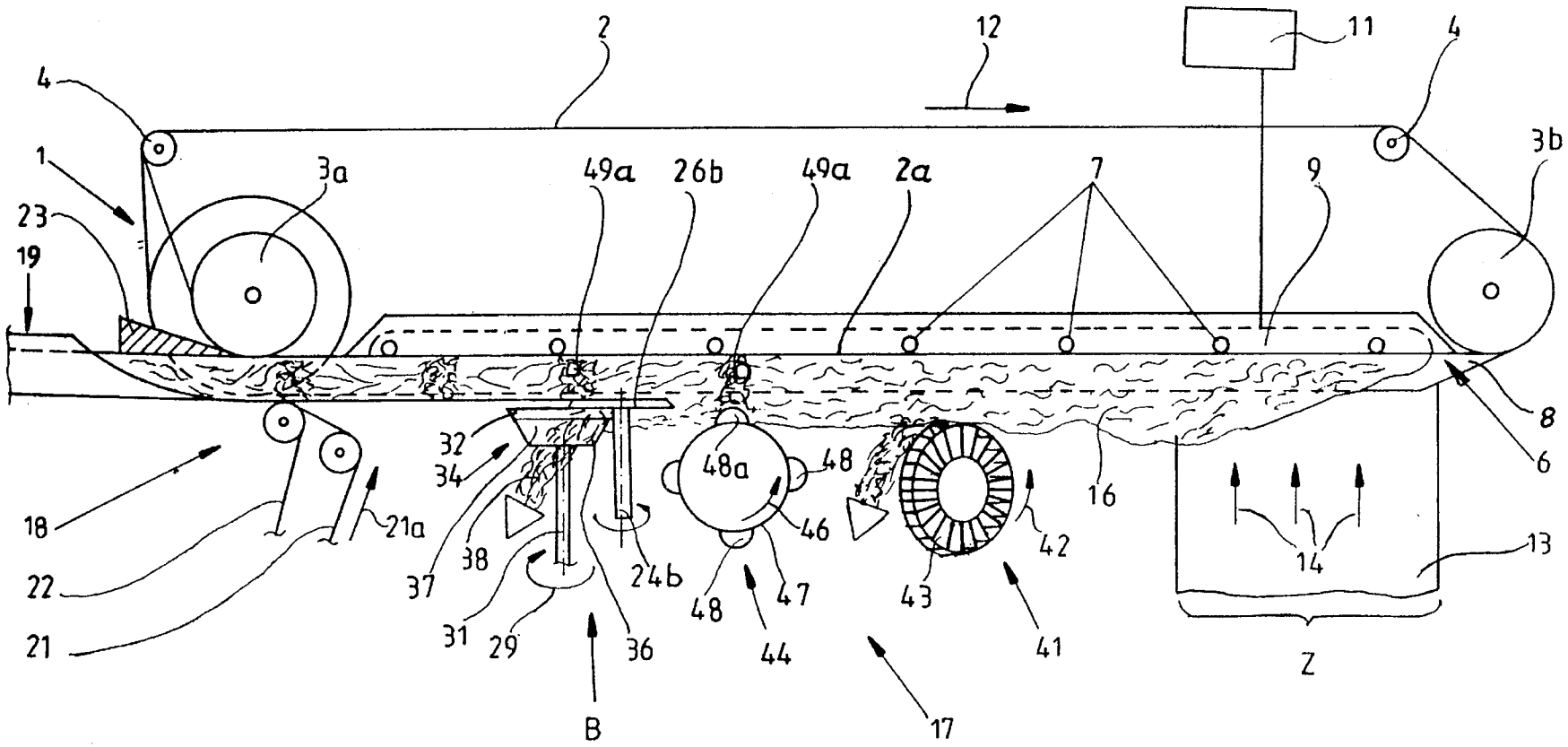
FIG. 1 is a schematic side elevational view of a surplus removing apparatus which embodies one form of the invention, one sidewall of the transporting means being omitted.

FIG. 1 shows those parts of a cigarette making machine (e.g., a machine known as PROTOS which is produced and distributed by the assignee of the present application) which are necessary for full understanding of one presently preferred embodiment of the invention. The means for transporting a continuous surplus-containing stream 16 of tobacco particles along an elongated substantially horizontal path includes a pneumatic conveyor 1 having an endless foraminous belt 2 trained over pulleys 3*a*, 3*b* and 4, a suction chamber 9 at a level above the elongated planar lower stretch or reach 2*a* of the belt 2, and a suction generating device 11 which serves to draw air from the chamber 9 and to thus cause the tobacco stream 16 to adhere to and to advance with the lower reach or stretch 2*a*. The latter actually constitutes the means for advancing the stream 16 in the direction of the arrow 27 within an elongated channel 6 defined by two spaced-apart parallel sidewalls 8*a*, 8*b* and the reach 2*a*. The sidewalls 8*a*, 8*b* constitute two elongated portions of a shaped member 8 which is installed in the rod making machine. At least one of the pulleys 3*a*, 3*b*, 4 is driven by a suitable prime mover, not shown, and the lower reach 2*a* of the foraminous belt 2 advances beneath a set of transversely extending propping or backup rollers 7 which maintain the lower reach 2*a* in a desired plane. The arrow 12 indicates the direction of movement of the upper reach of the belt 2.

The endless belt 2 of the pneumatic conveyor 1 is perforated or is woven in such a way that it is provided with orifices or passages for the flow of atmospheric air upwardly through the tobacco stream 16, through the reach 2*a* and into the suction chamber 9.

The underside of the channel 6 is open and the surplus 38 of tobacco particles extends downwardly beyond a selected distance from the lower reach 2*a* of the belt 2. Tobacco particles which are to form the stream 16 are drawn or propelled upwardly (arrows 14 in FIG. 1) within a duct 13 the discharge end of which cooperates with the adjacent portion of the lower reach 2*a* to define a stream building zone Z. The particles which advance in the direction indicated by the arrows 14 are supplied by a distributor which loosens the particles and breaks up eventual agglomerations or clumps of tobacco particles not later than in the lower portion of the duct 13. The rate of tobacco delivery by the duct 13 and the speed of the belt 2 are related to each other in such a way that each successive increment of the fully grown tobacco stream 16 contains a surplus 38 of tobacco particles. The surplus extends downwardly beyond the level of the undersides of the sidewalls 8*a* and 8*b*.

The stream building zone Z is located upstream of a composite trimming or equalizing assembly 17 which serves to remove the surplus 38 from the remainder (major portion) of the stream 16, and such remainder constitutes an elongated filler which is ready to be draped into a continuous web 21 of cigarette paper or other suitable wrapping material downstream of the equalizing assembly 17. The wrapping material 21 is fed upwardly (arrow 21*a*) toward and onto the upper reach of a driven endless belt 22 (called garniture) which is located at the discharge end 18 of the channel 6. A portion of the wrapping mechanism wherein the web 21 is draped around the filler (i.e., trimmed tobacco stream 16 which has been relieved of the surplus 38) is shown at 19. The wrapping mechanism comprises a customary finger 23 which is located above the path of advancement of successive increments of the trimmed tobacco stream onto the upper side of that portion of the web 21 which is being advanced by the garniture 22.

Figure 2:
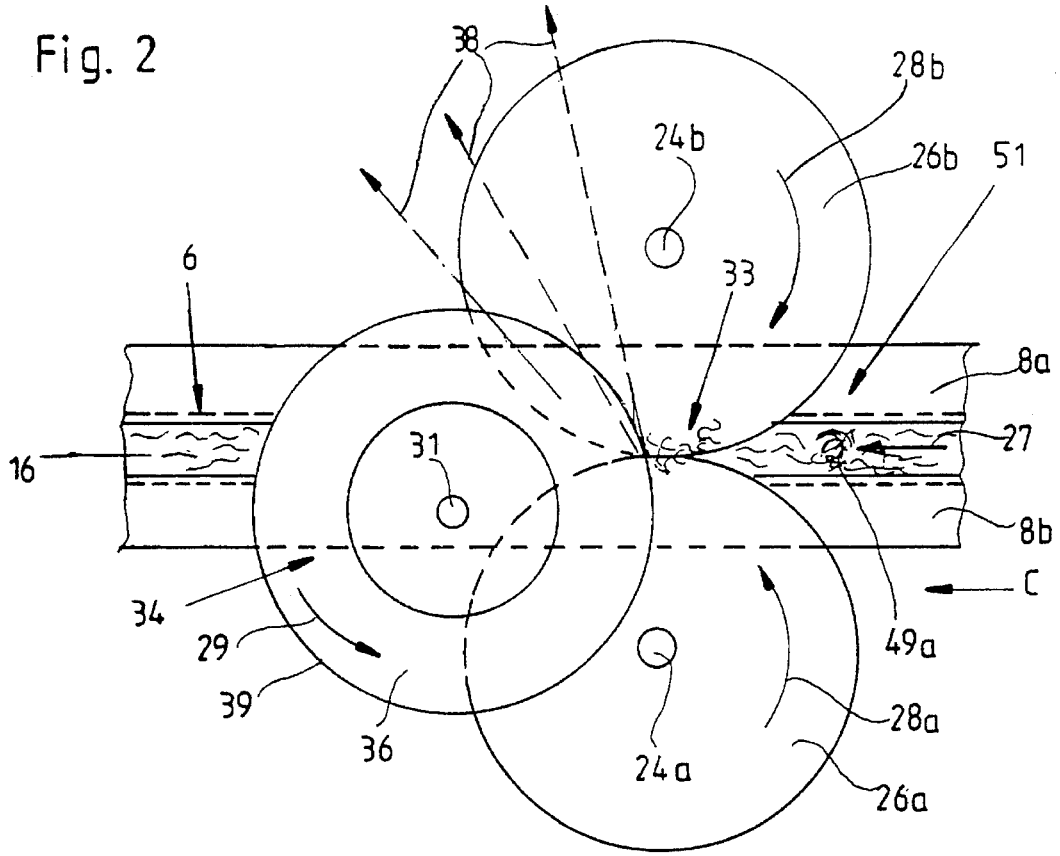
FIG. 2 is an enlarged bottom plan view of the trimming means and of the adjacent portion of the transporting means, substantially as seen in the direction of the arrow B in FIG. 1.
Figure 3:
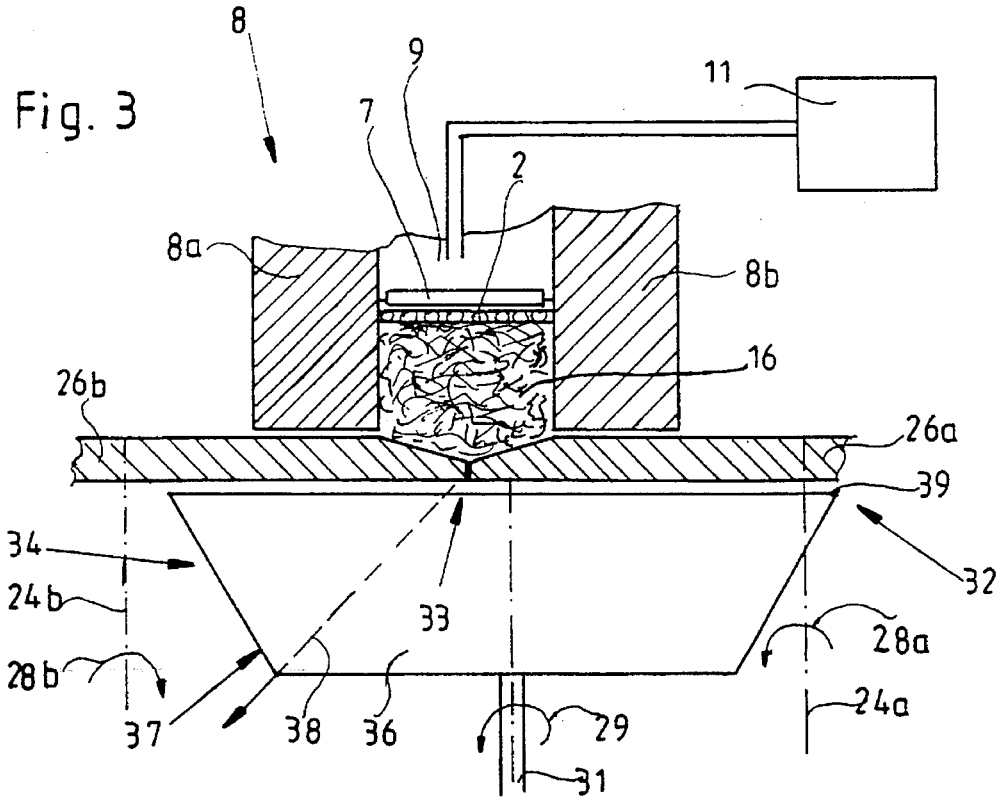
FIG. 3 is an elevational view of modified severing means, substantially as seen in the direction of arrow C in FIG. 2, and a transverse vertical sectional view of the gripping members and of the pneumatic conveyor and sidewalls of the transporting means.

The equalizing assembly 17 includes a trimming mechanism having two disc-shaped coplanar tobacco gripping or clamping members 26*a*, 26*b* located at a selected distance from and at a level below the lower reach 2*a* of the foraminous belt 2. As can be seen in FIG. 3, the plane of the gripping members 26*a*, 26*b* is immediately adjacent the undersides of the sidewalls 8*a*, 8*b*. The means for rotating the members 26*a*, 26*b* (note the arrows 28*a*, 28*b* in FIG. 2) includes two parallel vertical or nearly vertical shafts 24*a*, 24*b*. The peripheral surfaces of the gripping members 26*a*, 26*b* define a nip 51 (FIG. 2) which narrows in the direction (arrow 27) of advancement of the stream 16 in the channel 6. Successive increments of the surplus 38 advance at a level beneath the nip 51 (i.e., beneath the undersides of the members 26*a*, 26*b*. In other words, the peripheral surfaces of the members 26*a*, 26*b* engage the lowemost layer or portion of that part of the stream 16 which is to constitute a trimmed stream or filler ready to be draped into the web 21. As can be seen in FIG. 2, the shafts 24*a*, 24*b* rotate the respective gripping members 26*a*, 26*b* in opposite directions (as indicated by the arrows 28*a*, 28*b*) so that the peripheral surfaces of the gripping members move toward each other and clamp successive oncoming increments of the stream entering the nip 51. The latter is shown as being located exactly midway between the sidewalls 8*a* and 8*b* flanking the channel 6.

The disc-shaped gripping members 26*a*, 26*b* may but need not be located in a common plane. For example, their undersides can slope upwardly transversely of the channel 6 and away from the nip 51.

The trimming mechanism of the equalizing assembly 17 further comprises a rotary knife 32 having a circular cutting edge 39 which severs the surplus 38 off the remaining major portion of the stream 16 at or close to the nip 51 (FIG. 2). The means for rotating the knife 32 includes a shaft 31 which is driven to rotate the knife in the direction of the arrow 29. As can be seen in FIGS. 1 and 3, the upper side of the disc-shaped knife 32 is immediately or closely adjacent the undersides of the gripping members 26*a* and 26*b*.

FIG. 1 shows a knife 32 which is a separately produced component, and FIG. 3 shows a knife 32 which is of one piece with a coaxial deflector 34 forming part of means for directing the removed surplus 38 in one or more predetermined directions (as indicated in FIG. 2 by three broken-line arrows). If the knife 32 forms part of the deflector 34, the corresponding part of the deflector is preferably made of a hardened material which can stand extensive wear in actual use of the improved apparatus.

The arrow 33 denotes the actual cutting or severing station where the cutting edge 39 of the knife 32 severs successive increments of the surplus 38 off the major part of the stream 16 while the stream advances in the channel 6 in the direction of the arrow 27. The severing station 33 is preferably located in such a way that the rotating knife 32 severs the stream at or close to the locus where the peripheral surfaces of the gripping members 26*a*, 26*b* are nearest to or actually contact each other. The distance between the plane of the lower reach 2*a* of the endless foraminous belt 2 and the upper side of the knife 32 (i.e., the plane of the cutting edge 39) determines the quantity of tobacco which is severed from the stream 16 and constitutes the surplus 38.

It is possible to position the cutting edge 39 of the knife 32 in a plane which is not exactly parallel to the common plane of the undersides of the gripping members 26*a* and 26*b*. This reduces the likelihood of extensive wear upon the members 26*a*, 26*b* and/or knife 32 when the apparatus is in use. For example, the plane of the cutting edge 39 of the knife 32 shown in FIG. 1 can slope slightly downwardly and to the left away from the narrowest portion of the nip 51. As an alternative, the plane of the cutting edge 39 can be parallel to the common plane of the disc-shaped gripping members 26*a*, 26*b* as long as these members are not in actual contact with the knife 32.

It will be seen that the cutting edge 39 of the knife does not brush the surplus 38 off the major portion of the stream 16 and does not tear the particles of the surplus 38 from the tobacco stream portion immediately above the plane of the cutting edge 39; instead, the knife merely severs those particles of the stream which are located in part above and in part below such plane. This minimizes the extent of comminution of the particles in the surplus 38 as well as in the trimmed portion of the stream 16.

The deflector 34 which is shown in FIGS. 1 to 3 comprises a rotary body 36 which is coaxial or of one piece with the knife 32. The shaft 31 can serve as a means for rotating the knife 32 jointly with the rotary body 36, and the peripheral surface 37 of the rotary body 36 is configurated and dimensioned in such a way that it propels the tobacco particles which form the surplus in one or more desired directions for convenient and predictable transport back into the distributor or hopper of the rod making machine. The peripheral surface 37 which is shown in FIG. 3 is a conical frustum. The configuration of such surface can be at least slightly different, e.g., the surface 37 can be slightly concave between the upper side and the underside of the rotary body 36. The configuration of the peripheral surface 37 is selected with a view to direct the particles of the surplus 38 in one or more desired directions as well as to ensure that the particles of the surplus are advanced in the desired direction or directions without any, or without appreciable, comminution on their way back toward the magazine of the distributor. This is in contrast to the action of a paddle wheel or a milling cutter each of which is much more likely to comminute the particles of the surplus than the novel combination of the knife 32 (with its circular cuting edge 39) and the deflector 34 (with its deflecting and directing surface 37). In other words, the knife 32 cooperates with the deflector 34 to ensure that the consistency of tobaco particles forming the surplus 38 does not change at all, or is changed only negligibly, as a result of steering it into one or more desired directions.

An advantage of the trimming unit which is shown in FIG. 1 is that the separately produced knife 32 can be replaced with a fresh knife, if and when necessary. On the other hand, the structure which is shown in FIG. 3 exhibits the advantage that the knife 32 can be shaped as an integral part of the deflector 34; all that is necessary is to adequately harden the uppermost portion of the deflector 34 of FIG. 3 prior or subsequent to the shaping of the cutting edge 39. It goes without saying that the separately produced knife 32 which is shown in FIG. 1 also consists of a material which can stand long periods of use without extensive wear.

As a rule, the underside of the stream 16 which is formed in the stream building zone Z and advances toward the equalizing mechanism 17 exhibits pronounced hills and valleys. This can be seen in the right-hand portion of FIG. 2. It is clear that the minimum distance between the underside of the unequalized stream 16 and the underside of the lower reach 2*a* of the endless belt 2 should not be less than the selected height of the trimmed stream. Thus, it is necessary to form or build a stream 16 having a minimum height not less than the aforementioned minimum distance. In order to avoid unnecessary comminution of tobacco particles at the severing station 33, the improved apparatus preferably further comprises a second or preliminary trimmer 41 which is located upstream of the nip 51 and removes some of the surplus 38 ahead of the cutting edge 39 of the rotary knife 32. The illustrated trimmer 41 comprises a rotary brush or paddle wheel 43 which is driven to rotate in the direction of the arrow 42 and to remove a portion of the surplus 38 without any or without any extensive comminution of the removed particles. This will be readily appreciated since the illustrated paddle wheel 43 is not called upon to remove surplus from a stream which is being clamped or gripped between two rotary gripping members. As can be seen in FIG. 1, the underside of the stream 16 which advances beyond the paddle wheel 43 is at least substantially even but the height of such partially trimmed stream is still sufficient to ensure that some surplus will extend downwardly beyond the plane of the cutting edge 39 when it reaches the cutting station 33. That part of the surplus 38 which is removed by the paddle wheel 43 is also returned into the distributor, for example, jointly with the surplus which is being severed off the once trimmed stream by the knife 32.

The axis of the paddle wheel 43 is inclined relative to the direction (arrow 27) of advancement of the stream 16 from the stream building zone Z toward the nip 51 of the gripping members 26*a*, 26*b*. Such orientation of the rotational axis of the paddle wheel 43 relative to the direction of advancement of the stream past the preliminary or first trimming station ensures that the paddle wheel propels the separated particles sideways, i.e., to one side of the path for the stream 16.

FIG. 1 further shows a tobacco compacting unit 44 which is disposed beneath the channel 6 between the paddle wheel 43 and the gripping members 26*a*, 26*b*. The compacting unit 44 comprises a rotary holder 47 which is driven to rotate in the direction of the arrow 46 and carries a set of equidistant projections in the form of lobes 48 serving to compact longitudinally spaced apart portions 49*a* of the advancing once trimmed stream 16. This ensures that the filler which advances beyond the nip 51 toward and onto the web 21 of wrapping material comprises a plurality of equidistant densified portions. The cigarette rod is severed by a well known cutoff in such a way that each end or one end of each plain cigarette, cigar or cigarillo contains more tobacco than the remaining portion of the respective filler.

The operation is as follows:

The tobacco stream 16 which is built in the zone Z is advanced by the lower reach 2*a* of the foraminous belt 2 in the direction of the arrow 27, i.e., in the channel 6 between the sidewalls 8*a*, 8*b* and below the lower reach 2*a*. The paddle wheel 43 removes some of the surplus to eliminate pronounced hills of surplus tobacco particles and to ensure more predictable densification or compacting of spaced-apart portions of the once trimmed stream 16 as well as to establish more predictable circumstances for the removal of the remaining surplus from the stream which advances toward and beyond the nip 51 and onto the web 21 of wrapping material on the upper reach of the garniture 22. The lobes 48 of the rotary holder 47 densify the spaced apart portions 49*a* of the once trimmed stream 16 sufficiently close to the nip 51 to thus ensure that the densified portions continue to contain more tobacco than the neighboring portions of the stream 16, i.e., the filler which advances beyond the station 33 continues to comprise portions which contain more tobacco than the portions between such densified portions. FIG. 1 shows one of the lobes 48 (denoted by the character 48*a*) in the process of providing the adjacent part of the stream 16 with a densified portion 49*a*.

Those increments of the once trimmed stream 16 which reach the nip 51 still contain a substantial amount of surplus, and such surplus is removed by the cutting edge 39 of the rotating knife 32 in cooperation with the gripping members 26*a* and 26*b*. The surface 37 of the deflector 34 directs the removed surplus 38 in the desired direction for convenient collection and transport back to the magazine of the distributor of the rod making machine. For example, a single conveyor (not specifically shown) can be employed to collect the removed surplus 38 upon deflection by the surface 37 and to transport it back into the distributor for use in the making of the tobacco stream, i.e., for readmission into the duct 13.

The filler which advances beyond the station 33 contains longitudinally spaced apart densified portions and is advanced beyond the discharge end 18 of the channel 6, i.e., onto the web 21 of wrapping material and through the wrapping mechanism 19 which converts the web and the filler into a continuous cigarette, cigar or cigarillo rod ready to be subdivided into plain cigarettes, cigars or cigarillos of unit length or multiple unit length. If the apparatus utilizes the compacting unit 44, the cigarette, cigar or cigarillo rod is severed across or adjacent the densified portions of its filler.

The axis of the shaft 31 for the knife 32 and the deflector 34 is preferably parallel to the axes of the shafts 24*a*, 24*b* for the gripping members 26*a*, 26*b*. This contributes to gentle treatment of severed surplus 38 during advancement of its particles in one or more desired directions.

In many conventional trimming apparatus, densified portions of the trimmed stream are obtained by providing the gripping members with circumferentially spaced apart pockets which extend from the respective gripping members in a direction away from the channel. Reference may be had, for example, to the aforementioned published German patent application Ser. No. 29 49 494. The gripping members 26*a*, 26*a* which are utilized in the apparatus of the present invention cannot be provided with such pockets because this would prevent the cutting edge 39 of the rotary knife 32 from severing the surplus 38 off the remainder of the tobacco stream immediately adjacent the undersides of the members 26*a*, 26*b*. However, the rotary compacting unit 44 has been found to even more satisfactorily ensure predictable compacting or densification of longitudinally spaced apart portions of the once trimmed stream which advances from the paddle wheel 43 toward the nip 51 of the gripping members 26*a*, 26*b*. The apparatus which is described and shown in the aforementioned U.S. Pat. No. 4,210,159 also employs gripping or clamping members with circumferentially spaced apart pockets.

The compacting unit 44 exhibits the important advantage that the densified portions 49*a* need not be formed in the wrapping mechanism 19. Thus, if the densified portions are to be formed in a manner as disclosed in the published German patent application No. 29 49 494 or in the aforementioned U.S. Pat. No. 4,210,159, the densification of spaced-apart portions of the filler takes place in the wrapping mechanism proper. In other words, the tobacco filler rods issuing from the trimming units which are disclosed in the aforementioned prior publications contain portions having a first cross-sectional area alternating with portions of greater cross-sectional area. The portions of greater cross-sectional area are compacted in the wrapping mechanism. This is not necessary if one employs the apparatus of the present invention because the densification of the spaced-apart portions 49*a* takes place ahead of the wrapping mechanism 19 and remains at least substantially unchanged while the portions 49*a* advance toward and into the wrapping mechanism 19. The aforementioned holder 47 and its projections 48 constitute a highly satisfactory and reliable compacting unit which ensures predictable compacting or densification of the spaced-apart portions 49*a* of the once trimmed stream 16, especially in combination with the preliminary trimming unit including the paddle wheel 43 which effects an equalization of the stream 16 ahead of the region of engagement with successive lobes 48 of the holder 47. Such preliminary equalization ensures that each of a long or short series of successive densified portions 49*a* contains the same or nearly the same quantity of tobacco.

An important advantage of the improved apparatus is that the surplus 38 is removed without tearing of the tobacco particles because the particles including portions in the surplus 38 and portions in the remaining major portion of the stream 16 are severed by the cutting edge 39 of the rotary knife 32. This does not involve any undue or undesirable comminution of the tobacco particles and contributes to the quality of the filler containing tobacco particles which are not severed during advancement past the nip 51 as well as some particles which constituted the surplus 38 and were returned into the distributor of the rod forming machine.

The provision of the diverting means including the deflector 34 also contributes to the quality of the particles forming the surplus 38 because such particles can be readily gathered and returned into the distributor without any or with negligible additional comminution.

An additional feature of the improved apparatus is that it employs a very compact preliminary surplus removing unit 41, a compact compacting unit 44 and a compact trimming unit including the knife 32 and the deflector 34. Consequently, the three units can be placed close to each other and close to the discharge end 18 of the channel 6 so that the compacted or densified portions 49*a* of the twice trimmed stream 16 remain adequately densified at the time they enter the wrapping mechanism 19. This contributes to a much more predictable making of plain cigarettes, cigars or cigarillos having dense ends.

All in all, the improved apparatus contributes to the mass production of more satisfactory rod-shaped articles of the tobacco processing industry and its cost does not exceed or need not exceed the cost of heretofore known surplus removing apparatus.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. Apparatus for removing surplus from a stream of tobacco particles, comprising means for transporting the stream in a predetermined direction along a predetermined path including a pneumatic conveyor having means for advancing the stream along said path and two sidewalls flanking said path with the surplus extending beyond a predetermined distance and in a direction away from said advancing means; means for trimming the surplus off the stream including two rotary gripping members spaced apart from said conveyor and having circular peripheral surfaces defining a nip which is disposed between said sidewalls at least substantially at said predetermined distance from said advancing means and receives successive increments of the stream between the surplus and the stream portion intermediate said nip and said advancing means, means for rotating said gripping members in opposite directions, and means for severing the surplus off the remainder of the stream at said nip including a rotary knife having a substantially circular cutting edge adjacent said gripping members with the gripping members disposed between said knife and said advancing means; means for compacting spaced-apart portions of the stream upstream of and close to said nip, including a driven rotary holder and at least one projection provided on said holder and positioned to compact an adjacent portion of the stream during each revolution of the holder; and means for directing the severed surplus in at least one predetermined direction, including a rotary deflector which is coaxial with said rotary knife, wherein said gripping members are disposed in a first plane and said cutting edge is disposed in a second plane adjacent and substantially parallel to said first plane.

2. The apparatus of claim 1, wherein said nip is disposed substantially midway between said sidewalls.

3. The apparatus of claim 1, wherein said advancing means includes a substantially planar stream contacting portion between said sidewalls and said trimming means further includes means for rotating said knife about an axis which is at least substantially normal to the plane of said stream contacting portion.

4. The apparatus of claim 1, wherein said deflector has a side confronting said gripping members and said knife is disposed at said side of said deflector.

5. The apparatus of claim 1, wherein said deflector has a substantially frustoconical deflecting surface for the severed surplus.

6. The apparatus of claim 1, wherein said deflector has a substantially concave deflecting surface for the severed surplus.

7. The apparatus of claim 1, wherein said knife constitutes a portion of said directing means.

8. The apparatus of claim 7, wherein at least said portion of said directing means consists of a wear-resistant material.

9. The apparatus of claim 1, further comprising means for removing some of the surplus from the stream upstream of said nip to thus at least substantially equalize the stream prior to removal of the remaining surplus by said trimming means.

10. The apparatus of claim 9, wherein said removing means comprises a driven paddle wheel.

11. The apparatus of claim 10, wherein said paddle wheel is rotatable about an axis which is inclined relative to said predetermined direction.

12. The apparatus of claim 1, wherein said sidewalls and said advancing means define an elongated channel having an open side, said trimming means being disposed at said open side of said channel.

13. The apparatus of claim 12, wherein said open side is disposed at a level beneath said advancing means.

14. The apparatus of claim 1, wherein said conveyor includes an endless foraminous belt and said advancing means includes an elongated stretch of said belt, said stretch extending in said predetermined direction and being disposed at a first level, said trimming means being disposed at a second level other than said first level.

15. The apparatus of claim 1, wherein each of said peripheral surfaces is located in a single plane.

16. The apparatus of claim 1, wherein said peripheral surfaces are devoid of pockets.

* * * * *